US010900337B2

(12) United States Patent
Trost

(10) Patent No.: US 10,900,337 B2
(45) Date of Patent: Jan. 26, 2021

(54) WOBBLE PUMP COMPRISING A WOBBLE PLATE

(71) Applicant: IFP Energies nouvelles, Rueil-Malmaison (FR)

(72) Inventor: Julien Trost, Paris (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 16/480,610

(22) PCT Filed: Jan. 16, 2018

(86) PCT No.: PCT/EP2018/051013
§ 371 (c)(1),
(2) Date: Jul. 24, 2019

(87) PCT Pub. No.: WO2018/137974
PCT Pub. Date: Aug. 2, 2018

(65) Prior Publication Data

US 2019/0360473 A1 Nov. 28, 2019

(30) Foreign Application Priority Data

Jan. 25, 2017 (FR) ..... 50.584

(51) Int. Cl.

| | |
|---|---|
| ***E21B 43/12*** | (2006.01) |
| ***E21B 21/00*** | (2006.01) |
| ***F04B 1/148*** | (2020.01) |
| ***E21B 43/00*** | (2006.01) |
| ***F04B 1/16*** | (2006.01) |
| ***F04B 1/146*** | (2020.01) |
| ***F04B 1/124*** | (2020.01) |

(52) U.S. Cl.
CPC ..... *E21B 43/126* (2013.01); *E21B 21/00* (2013.01); *E21B 43/00* (2013.01); *F04B 1/124* (2013.01); *F04B 1/146* (2013.01); *F04B 1/148* (2013.01); *F04B 1/16* (2013.01)

(58) Field of Classification Search
CPC ..... E21B 43/126; E21B 43/00; E21B 21/00; F04B 1/148; F04B 1/146; F04B 1/16; F04B 1/124
See application file for complete search history.

(56) References Cited

U.S. PATENT DOCUMENTS 3,712,758 A * 1/1973 Lech ..... F04B 1/124 417/214
4,037,993 A 7/1977 Roberts
(Continued)

FOREIGN PATENT DOCUMENTS

EP 0005566 A1 11/1979
FR 1303796 A 9/1962

OTHER PUBLICATIONS

International Search Report for PCT/EP2018/051013, dated Apr. 10, 2018; English translation submitted herewith (5 pgs.).

*Primary Examiner* — Nicole Coy
(74) *Attorney, Agent, or Firm* — Fitch, Even, Tabin & Flannery, L.L.P.

(57) ABSTRACT

The present invention relates to a barrel-type piston pump (1) with a swash plate (7) where the angle of inclination of rotary plate (2) relative to drive shaft (5) is adjustable by means of a finger joint (8).

13 Claims, 4 Drawing Sheets

(56) References Cited

U.S. PATENT DOCUMENTS

| | | | | |
|---|---|---|---|---|
| 4,535,429 | A * | 8/1985 | Russell | E21B 47/24 367/85 |
| 5,295,796 | A | 3/1994 | Goto et al. | |
| 5,979,294 | A * | 11/1999 | Hugelman | F04B 1/146 91/505 |
| 6,098,519 | A * | 8/2000 | Takahashi | F04B 1/122 417/269 |
| 6,176,684 | B1 | 1/2001 | Zimmermann | |
| 6,361,286 | B1 * | 3/2002 | Takahashi | F04B 1/122 417/269 |
| 7,047,867 | B2 * | 5/2006 | Kalkstein | F04B 1/295 417/271 |
| 7,794,212 | B2 * | 9/2010 | Hugelman | F04B 1/128 417/269 |
| 2003/0206811 | A1 * | 11/2003 | Maki | F04B 53/109 417/222.1 |
| 2009/0007773 | A1 * | 1/2009 | Zhu | F04B 1/128 91/505 |
| 2011/0197752 | A1 * | 8/2011 | Hugelman | F04B 25/04 92/12.2 |
| 2014/0186196 | A1 * | 7/2014 | Mizoguchi | F04B 1/324 417/269 |
| 2019/0113028 | A1 * | 4/2019 | Hemink | F01B 3/101 |

* cited by examiner

WOBBLE PUMP COMPRISING A WOBBLE PLATE

CROSS-REFERENCE TO RELATED APPLICATIONS

This application is a U.S. national phase application filed under 35 U.S.C. § 371 of International Application No. PCT/EP2018/051013, filed Jan. 16, 2018, designating the United States, which claims priority from French Patent Application No. 17/50.584, filed Jan. 25, 2017, which are hereby incorporated herein by reference in their entirety.

FIELD OF THE INVENTION

The present invention relates to the field of pumps, in particular for high-pressure pumping, notably for drilling operations.

BACKGROUND OF THE INVENTION

Today, crankshaft drive pumps are the most widely used across all industry sectors: capital goods, oil, gas and food industries, automotive industry, building industry (heating, wells, air conditioning, water pumps, etc.), and more specifically for water and waste treatment (water network and wastewater system). However, they are still manufactured on the basis of designs dating from the 1930*s*, and very few research and development surveys have been carried out to improve their performances, reduce their cost price, minimize their maintenance costs or decrease their environmental footprint. These pumps have limits in terms of power, pressure/flow rate torque (limited by pressure surges generated by the sinusoidal pressure of the crankshaft), weight, efficiency and service life. Furthermore, they do not allow to have a variable displacement and they therefore lack flexibility in use.

Besides, in the field of hydrocarbon production, it is currently observed that wellbores need to reach increasingly great depths, which involves working at increasingly high injection pressures. Oil companies therefore need ultra-high pressure pumps (for drilling mud injection for example) to reach the required depths. These pumps must also be reliable, economical, flexible and compact, so as to meet the ever more demanding requirements of the energy sector.

Another positive-displacement pump technology is the barrel-type piston pump. It is mainly intended for pumping at lower pressure and flow rate (it is mainly used for pumping hydraulic oils) and it has many advantages:

- excellent weight/power ratio
- very good price/performance ratio
- interesting mechanical and volumetric efficiencies
- variable displacement capacity through plate inclination adjustment.

Pumps designed with a barrel operate by means of a rotary plate system that actuates the various pistons one after another. When a piston is in an intake phase, the opposite piston is in delivery mode, which provides a constant flow upstream and downstream from the pump. The distribution of the piston positions guided by the barrel provides a progressive distribution of the forces upon rotation of the shaft driven by the motor.

There are three main barrel-type pump architectures:

- stationary barrel pumps (FIG. 1): in this configuration of pump 1, where the barrel is stationary, it is inclined plate 2 that rotates (driven by shaft 5) so as to generate the motion of pistons 3 in their sleeves 4. The link between pistons 3 and plate 2 is then provided by ball joint pads that rub on plate 2. The advantage here is a very low inertia of the rotating parts;
- rotating barrel pumps (FIG. 2): within pump 1, it is plate 2 that is stationary and barrel 6 carrying pistons 3 rotates, which provides motion of pistons 3 in their sleeves 4. The link between piston 3 and plate 2 is provided in the same manner as for the first configuration. The advantage of this architecture is that the plate can be readily adjusted in inclination, which makes it possible to have a variable displacement. On the other hand, the inertia of the rotating parts increases in a quite significant manner since the barrel and all of the pistons are rotated;
- barrel pumps in a swash plate design: the barrel is stationary in this architecture and there are two plates, a first inclined plate rotates and transmits to the second plate only the oscillating motion. Thus, the pistons can be linked to the second plate, the swash plate, without friction members being required, for example with a connecting rod linked to the piston and to the plate by ball joint links. It is the only architecture suited to high-pressure pumping due to the absence of friction elements (moreover, some can be found on the geothermal energy market). It provides an excellent mechanical efficiency.

Examples of variable displacement barrel pumps where the rotary plate inclination is adjustable are described in the following patent applications: US-2014/0,186,196, U.S. Pat. Nos. 6,176,684, 5,295,796. For the pumps described in these patent applications, the inclination adjustment systems are either a servo-piston or a system with an electric motor and cams, or a hydraulic system. These systems are complex and they are not entirely satisfactory.

In order to overcome these drawbacks, the present invention relates to a barrel-type piston pump in a swash plate design where the angle of inclination of the rotary plate relative to the drive shaft is adjustable by means of a finger joint. Thus, the plate inclination is continuously adjustable, which enables a variable displacement. Furthermore, the pump according to the invention provides good flexibility due to the continuous variation of the unit cylinder displacement, and to a good reliability thanks to the possibility of progressive start-up of the pump. Besides, a compact design of the pump can be achieved in form of a barrel-type pump.

SUMMARY OF THE INVENTION

The invention relates to a barrel-type piston pump comprising a casing and comprising, within said casing:

- a drive shaft,
- a rotary plate driven by said drive shaft,
- a swash plate caused to oscillate by said rotary plate, and said swash plate being pivotably connected about the axis of said rotary plate relative to said rotary plate,
- a cylinder block comprising at least two circumferentially distributed compression chambers, and
- at least two pistons in translation respectively in said compression chambers of said cylinder block, said pistons being driven by said swash plate by means of connecting rods, said rotary plate being driven by said drive shaft by means of a finger joint, the position of said finger joint determining the inclination of said rotary plate and of said swash plate relative to said drive shaft.

According to an embodiment of the invention, the pump comprises a return rod, said return rod being in ball jointed connection with said casing and said swash plate.

Advantageously, the angle of inclination of said rotary plate and of said swash plate relative to the axis of said drive shaft ranges between 70° and 90°.

According to an implementation, said rotary plate comprises a groove in which the finger of said finger joint moves, said groove being substantially parallel to the axis of said drive shaft.

According to an embodiment option, said pump comprises means for controlling the inclination of said rotary plate relative to said drive shaft.

According to a first variant, the energy of said control means comes from a source external to said pump, in particular by means of a fluid under pressure.

According to a second variant, the energy of said control means is taken from said drive shaft.

Advantageously, said cylinder block is stationary relative to said casing.

Furthermore, the invention relates to a use of said barrel-type pump according to one of the above characteristics for a drilling operation, in particular for injecting drilling mud into a wellbore.

BRIEF DESCRIPTION OF THE FIGURES

Other features and advantages of the device according to the invention will be clear from reading the description hereafter of embodiments given by way of non-limitative example, with reference to the accompanying drawings wherein.

DETAILED DESCRIPTION OF THE INVENTION

Figure 1:
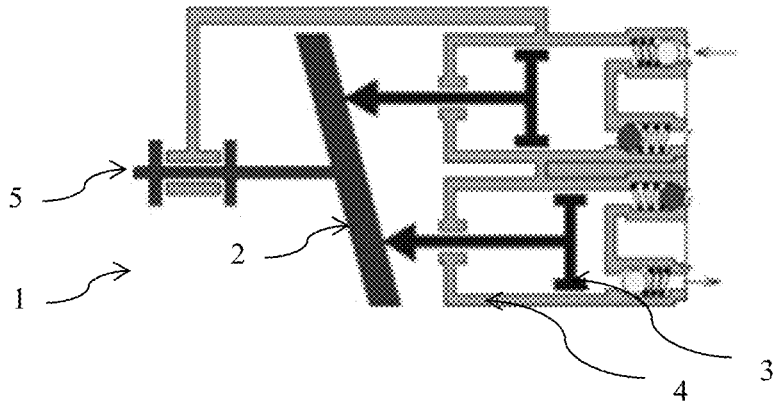
Prior Art Figure 1
FIG. 1, already described, illustrates a stationary barrel pump according to the prior art, FIG. 2, already described, illustrates a rotating barrel pump according to the prior art.
Figure 2:
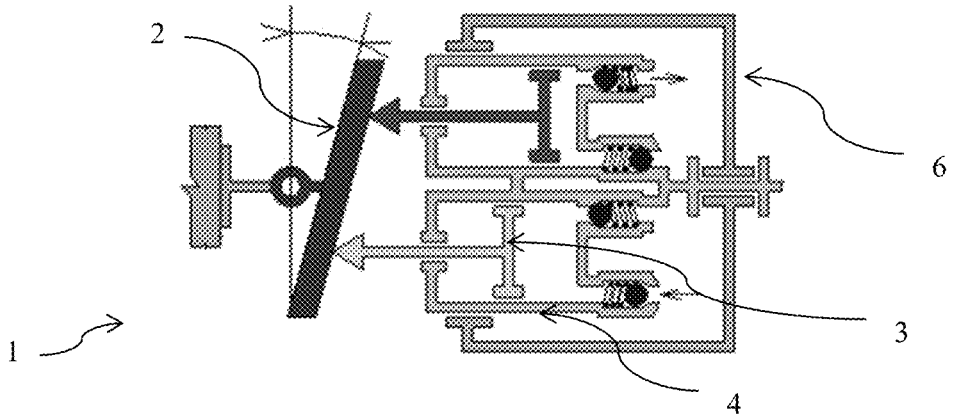
Prior Art Figure 2

The present invention relates to a barrel-type pump in a swash plate design. The purpose of the barrel pump is to pump a fluid (for example water, oil, gas, drilling mud, etc.) through a linear displacement of several pistons. This type of pump affords the advantage of being compact, of having interesting mechanical and volumetric efficiencies, as well as an excellent weight/power ratio. Furthermore, barrel pumps in a swash plate design are suited for high-pressure pumping.

The barrel pump according to the invention comprises a casing and it comprises within the casing:

- a drive shaft driven in rotation relative to the casing by an external energy source, notably a prime mover (thermal or electric for example), in particular by means of a transmission (a gearbox for example),
- a rotary plate driven by the drive shaft: the rotary plate is inclined relative to the drive shaft; the inclination of the rotary plate generates an oscillating motion of the rotary plate; the rotary plate has a rotational motion and an oscillating motion relative to the casing,
- a swash plate caused to oscillate by the rotary plate: the swash plate is pivotably connected about the axis of the rotary plate relative to the rotary plate; the rotary plate only transmits the oscillating motion to the swash plate and it does not transmit the rotational motion,
- a cylinder block (referred to as barrel) comprising at least two circumferentially distributed (in other words, arranged in a circle) compression chambers (also referred to as sleeves), and
- at least two pistons in translation respectively in the compression chambers, the pistons are driven by the swash plate by means of connecting rods (the rods connect, through the agency of ball joint links, the swash plate and the pistons so as to convert the oscillating motion to a translational motion of the pistons), and the translation of the pistons within the compression chambers generates pumping of the fluid.

According to the invention, the rotary plate is driven by the drive shaft by means of a finger joint, the position of the finger joint determining the inclination of the two plates (rotary and swash plate) relative to the drive shaft. It is reminded that a finger ball joint link is a link between two elements (here the drive shaft and the rotary plate) having four degrees of linkage and two degrees of relative motion; only two relative rotations are possible, the three translations and the last rotation being linked. In general, it is a ball joint provided with a finger that prevents rotation. For the invention, the finger of the ball joint allows the inclination of the plates to be adjusted relative to the drive shaft. Indeed, the pump comprises means for controlling the finger joint, and therefore the inclination of the plates relative to the drive shaft.

Thus, the inclination of the rotary and swash plates is continuously adjustable, which enables a variable displacement. Indeed, the inclination of the plates influences the stroke of the pistons. Furthermore, the pump according to the invention enables good flexibility thanks to the continuous variation of the unit cylinder displacement. Moreover, the pump according to the invention enables good reliability thanks to the possibility of progressive start-up of the pump: for example, upon start-up, the angle of inclination may be small and, subsequently, it can be increased depending on the desired conditions (fluid flow rate and pressure). This reliability cannot be obtained with a pump whose plate inclination is fixed, or whose plate inclination cannot be continuously varied.

The plates can have substantially the shape of a disc. However, the plates may have any shape. Only the compression chambers (and the pistons) are arranged in a circle.

Advantageously, the pump according to the invention can comprise a number of pistons ranging between three and fifteen, preferably between five and eleven. Thus, a large number of pistons provides a continuous flow upstream and downstream from the pump.

Thus, by means of this system, the rotational motion at the inlet (drive shaft) is first converted to an oscillating motion (swash plate), then to a translational motion, i.e. a reciprocating motion (pistons). The reciprocating motion of the pistons in the compression chambers provides pumping of the fluid.

Conventionally, the pump further comprises an inlet and an outlet for the fluid to be pumped. The fluid passes through the pump inlet, flows into a compression chamber, where it is compressed, then it is discharged from the pump through the outlet by means of the piston.

In addition, conventionally, the pivot links consist of bearings or rollers, promoting the relative motion of the elements.

According to an embodiment of the invention, adjustment of the inclination can be achieved by moving the finger of the ball joint in a groove provided in the rotary plate, and the axis of the groove can be parallel to the axis of rotation of the drive shaft.

According to an implementation of the invention, continuous adjustment of the inclination (for example the movement of the finger in the groove) can be provided in different ways, for example by means of a fluid under pressure supplied to the finger joint through a specific circuit.

According to a design of the invention, the energy required for adjusting the inclination (for example for the movement of the finger in the groove) can be taken from the energy used for the input shaft. Alternatively, the energy required for adjusting the inclination can come from an external source (an electric motor for example).

Preferably, the cylinder block (or barrel) is stationary relative to the casing. Thus, the energy supply for pumping is provided at the drive shaft only, through the rotation thereof; the number of rotating parts is thus limited.

According to an embodiment option of the invention, the pump further comprises a return rod. The return rod is arranged between the swash plate and the casing. The return rod is in ball jointed connection with the casing and the swash plate. The return rod makes it possible to prevent a rotating motion of the swash plate about the axis thereof. Thus, the swash plate is only driven by an oscillating motion.

Since the swash plate has no rotational motion, no friction element can be interposed between the swash plate and the rods transmitting the motion to the pistons.

According to an embodiment of the invention, the angle of inclination of the rotary plate relative to the axial direction of the drive shaft ranges between 70° and 90°. In other words, the rotary plate (and a fortiori the swash plate) is inclined at an angle ranging between 0° and 20° to a radial direction of the drive shaft.

Figure 3:
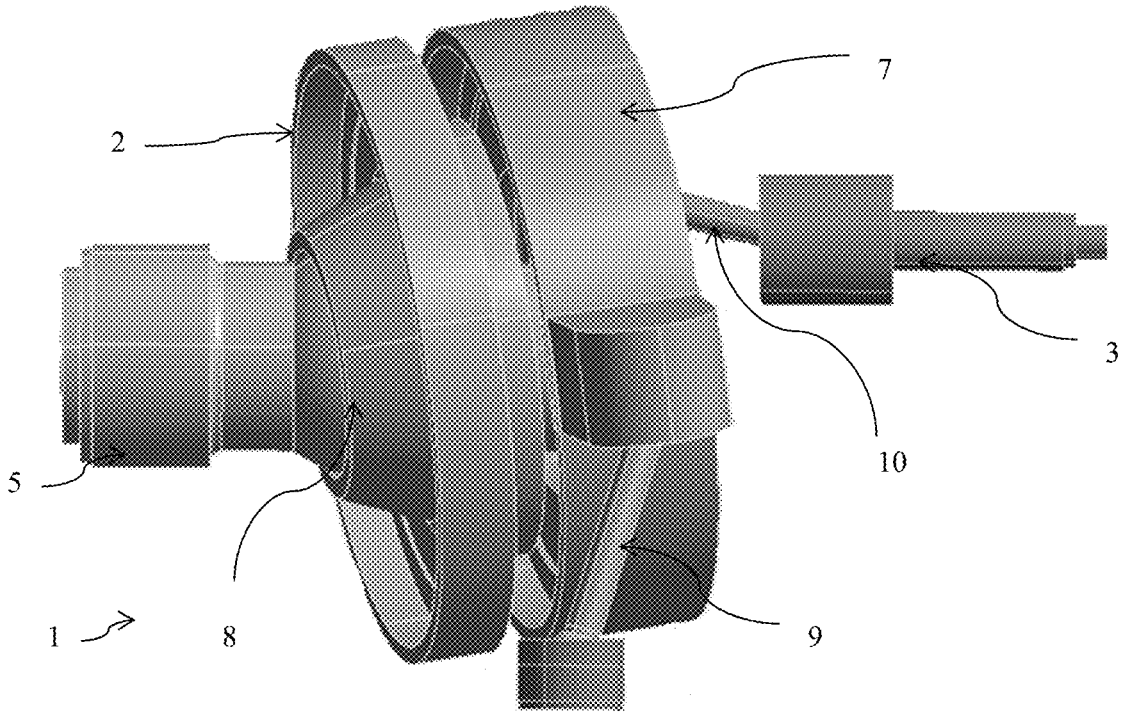
FIG. 3 illustrates a pump according to an embodiment of the invention, FIG. 4 schematically illustrates a pump according to an embodiment of the invention.
Figure 4:
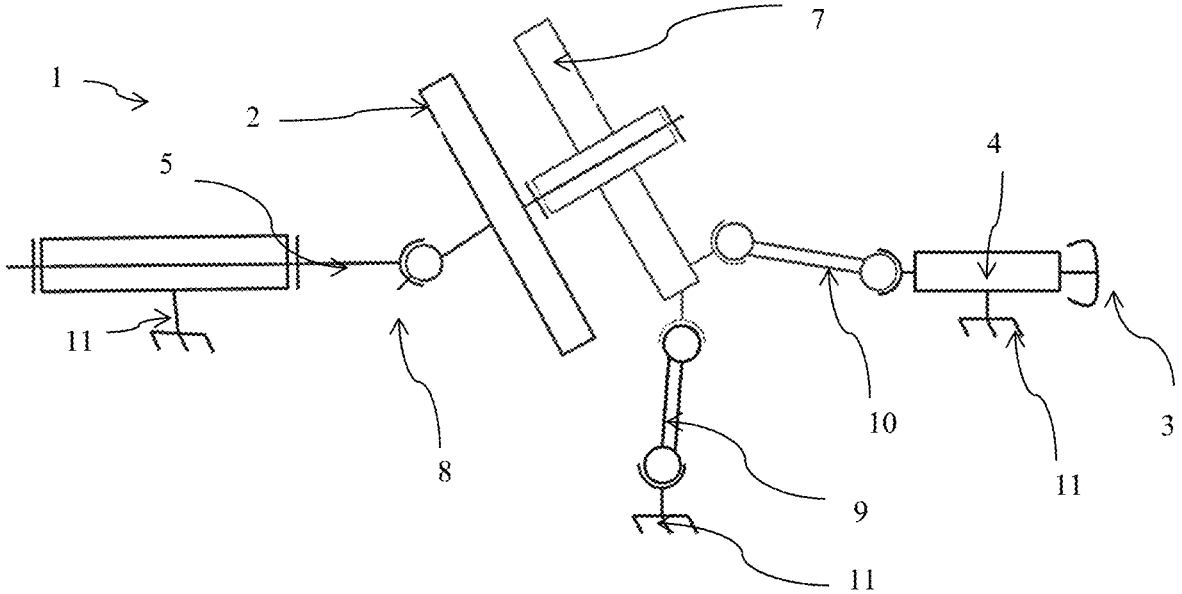

FIGS. 3 and 4 schematically illustrate, by way of non-limitative example, a barrel pump according to an embodiment of the invention. FIG. 3 is a three-dimensional view where the casing and the compression chambers are not shown. FIG. 4 is a kinematic diagram of the pump. In these figures, only one piston 3 is represented. However, the pump according to the invention comprises at least two pistons that are circumferentially distributed within a cylinder block.

For pump 1 according to the illustrated embodiment, drive shaft 5 is rotatingly mounted in a casing 11. The rotation of drive shaft 5 is performed by an external source, not shown, an electric machine and a gearbox for example. Drive shaft 5 drives rotary plate 2 by means of a finger ball joint link 8. The position of the finger joint allows to adjust the inclination of rotary plate 2 relative to drive shaft 5. Rotary plate 2 is linked to a swash plate 7 by a pivot link about the axis of the rotary plate. Pump 1 further comprises a return rod 9 arranged between swash plate 7 and casing 11 by means of ball joint links. Return rod 9 prevents rotation of swash plate 7 about the axis thereof. Pump 1 comprises a piston 3 driven by a translational motion (reciprocating motion) within a compression chamber 4. Compression chamber 4 belongs to the cylinder block (barrel) that is stationary relative to casing 11. The reciprocating motion of piston 3 is achieved by means of a rod 10 connecting swash plate 7 and piston 3 by means of ball joint links. This reciprocating motion of piston 3 within compression chamber 4 allows the fluid to be pumped.

Figure 5:
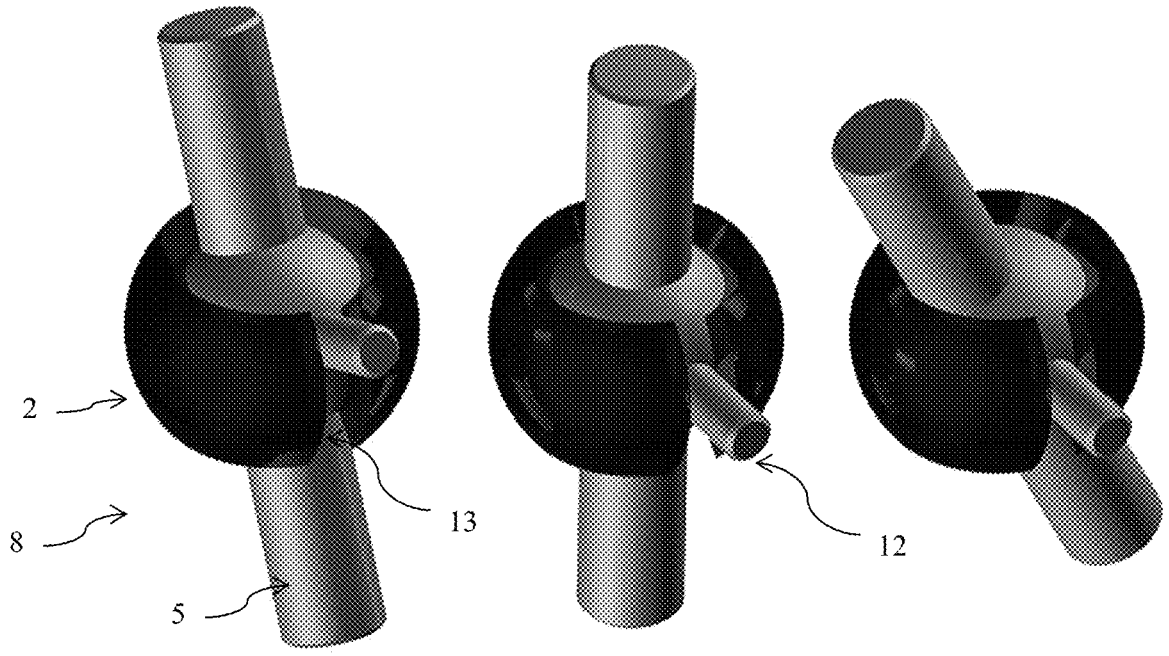
FIG. 5 illustrates a finger joint according to an embodiment of the invention in three positions.

FIG. 5 schematically shows, by way of non-limitative example, a finger joint in three positions according to an embodiment of the invention, in order to illustrate the relative motions between the rotary plate and the drive shaft. In this figure, rotary plate 2 is partly represented: only the central part of rotary plate 2 is illustrated. Finger joint 8 between drive shaft 5 and rotary plate 2 consists of a ball joint link between two spherical parts and of a finger 12 that moves in a groove 13 provided in rotary plate 2. Groove 13 is parallel to the axis of drive shaft 5. Thus, only two rotations between rotary plate 2 and the drive shaft are allowed. It is noted that the adjustment of the position of finger 12 in groove 13 allows to adjust the angle of inclination of rotary plate 2 relative to drive shaft 5.

The invention also relates to the use of the pump according to the invention for a drilling operation, in particular for injecting drilling mud into a wellbore. Indeed, the pump according to the invention is well suited for this use due to its flexibility, compactness and high pressure strength.

For example, the pump according to the invention can be sized to operate up to pressures of the order of 1500 bar, i.e. 150 MPa. Besides, the pump according to the invention can be sized to operate at flow rates ranging from 30 to 600 $m^3/h$.

Example

The features and advantages of the system according to the invention will be clear from reading the application example hereafter.

This example relates to a barrel-type pump according to the invention where the drive shaft is connected to a prime mover by means of an eight-speed gearbox. It is a 2500 HP (approximately 1900 kW) barrel pump comprising five pistons. Table 1 shows the rotational speed of the drive shaft as a function of the gearbox ratio.

TABLE 1

| | Ratio | | | | | | | |
|---|---|---|---|---|---|---|---|---|
| | 1 | 2 | 3 | 4 | 5 | 6 | 7 | 8 |
| Speed (rpm) | 198 | 269 | 300 | 365 | 407 | 485 | 555 | 660 |

This example notably shows the impact of the angle of inclination of the plates on the pressure and the flow rate for a barrel pump according to the invention.

Figure 6:
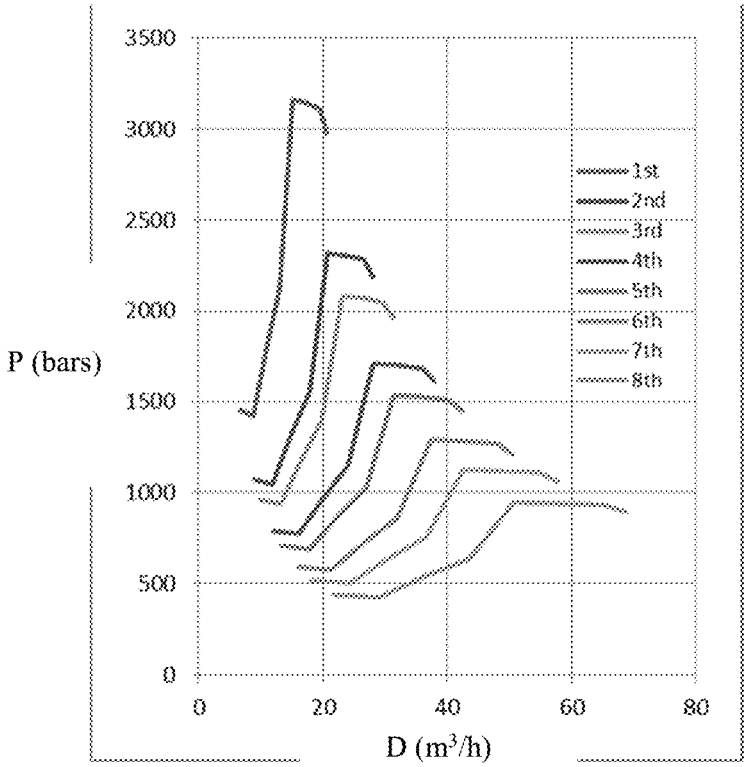
FIG. 6 shows pressure curves as a function of the flow rate for a pump according to the invention for various gear ratios with a plate inclined at 87° to the axis of the drive shaft.

FIG. 6 shows curves of the pressure P (in bar) as a function of the flow rate D (in $m^3/h$) for a pump according to the invention, for various gearbox ratios (denoted by 1st, 2nd, 3rd, . . . , 8th) with a plate inclined at 87° relative to the drive shaft axis (i.e. with an angle of 3° to a radial direction of the drive shaft).

Figure 7:
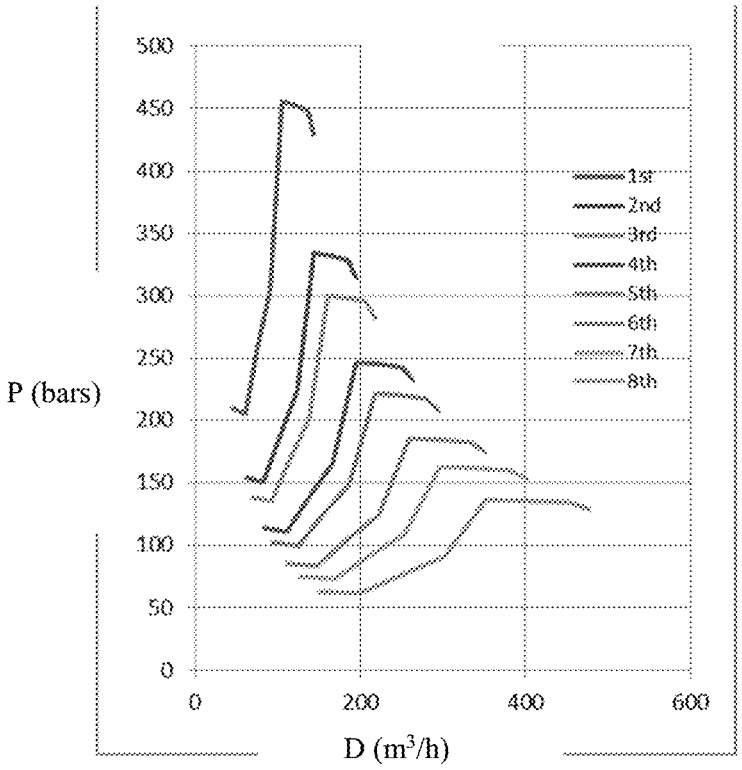
FIG. 7 shows pressure curves as a function of the flow rate for a pump according to the invention for various gear ratios with a plate inclined at 70° to the axis of the drive shaft.

FIG. 7 shows curves of the pressure as a function of the flow rate for a pump according to the invention (the same pump as the one used for FIG. 6), for various gearbox ratios (denoted by 1st, 2nd, 3rd, . . . , 8th) with a plate inclined at 70° relative to the drive shaft axis (i.e. with an angle of 20° to a radial direction of the drive shaft).

It is noted that an angle of inclination of the (rotary and swash) plates close to 90° allows higher pressures than an angle of inclination close to 70°. Furthermore, an angle of inclination of the plates close to 70° allows higher flow rates than an angle of inclination close to 90° (thanks to the variable displacement). It is thus possible to adjust the inclination of the plates depending on the desired pumping conditions (pressures, flow rates). It is also noted that, by means of the various gearbox ratios, the rotational speed of the drive shaft influences the pressure and the flow rate of the fluid: the pressure is higher at low speed and the flow rate is higher at high speed.

The invention claimed is:

1. A barrel-type piston pump comprising a casing and comprising within the casing:

a drive shaft, a rotary plate driven by the drive shaft, a swash plate caused to oscillate by the rotary plate, and the swash plate being pivotably connected about the axis of the rotary plate relative to the rotary plate, a cylinder block comprising at least two circumferentially distributed compression chambers, and at least two pistons in translation respectively in the compression chambers of the cylinder block, the pistons being driven by the swash plate by connecting rods, wherein the rotary plate is driven by the drive shaft by a finger joint, the position of the finger joint determining the inclination of the rotary plate and of the swash plate relative to the drive shaft, and the rotary plate comprises a groove in which a finger of the finger joint moves, the groove being substantially parallel to the axis of the drive shaft.

2. The pump as claimed in claim 1, wherein the pump further comprises a return rod, the return rod being in ball jointed connection with the casing and the swash plate.

3. The pump as claimed in claim 1, wherein the angle of inclination of the rotary plate and of the swash plate relative to the axis of the drive shaft ranges between 70° and 90°.

4. The pump as claimed in claim 1, wherein the pump comprises means for controlling the inclination of the rotary plate relative to the drive shaft.

5. The pump as claimed in claim 4, wherein the energy of the control means comes from a source external to the pump.

6. The pump as claimed in claim 5, wherein the source external to the pump comprises a fluid under pressure.

7. The pump as claimed in claim 4, wherein the energy of the control means is taken from the drive shaft.

8. The pump as claimed in claim 1, wherein the cylinder block is stationary relative to the casing.

9. A method for carrying out a drilling operation, comprising injecting drilling mud into a wellbore using the barrel-type piston pump as claimed in claim 1.

10. A barrel-type piston pump comprising:

a drive shaft, a rotary plate, a swash plate pivotably connected about the axis of the rotary plate, a finger joint connecting the drive shaft to the rotary plate, the position of the finger joint determining the inclination of the rotary plate and the swash plate relative to the drive shaft, the rotary plate comprising a groove in which a finger of the finger joint moves, the groove being substantially parallel to the axis of the drive shaft, a cylinder block comprising two compression chambers, pistons in the compression chambers, and connecting rods between the swash plate and the pistons.

11. The pump as claimed in claim 10, wherein the pump comprises a casing and a return rod, and the return rod is in ball jointed connection with the casing and the swash plate.

12. The pump as claimed in claim 10, wherein the angle of inclination of the rotary plate and of the swash plate relative to the axis of the drive shaft ranges between 70° and 90°.

13. A method for carrying out a drilling operation, comprising injecting drilling mud into a wellbore using the barrel-type piston pump as claimed in claim 10.

* * * * *